US009662528B2

(12) United States Patent
Wong

(10) Patent No.: US 9,662,528 B2
(45) Date of Patent: May 30, 2017

(54) TORSION BAR

(71) Applicant: Good Shine Development Ltd., Hong Kong (CN)

(72) Inventor: Ka Leung Wong, Hong Kong (CN)

(73) Assignee: GOOD SHINE DEVELOPMENT LTD. (CN)

( * ) Notice: Subject to any disclaimer, the term of this patent is extended or adjusted under 35 U.S.C. 154(b) by 11 days.

(21) Appl. No.: 14/827,426

(22) Filed: Aug. 17, 2015

(65) Prior Publication Data

US 2016/0045776 A1 Feb. 18, 2016

(30) Foreign Application Priority Data

Aug. 18, 2014 (CN) ..... 2014 2 0464999 U

(51) Int. Cl.

| | |
|---|---|
| ***A63B 21/045*** | (2006.01) |
| ***A63B 21/02*** | (2006.01) |
| ***A63B 21/00*** | (2006.01) |
| ***A63B 23/12*** | (2006.01) |
| ***A63B 23/14*** | (2006.01) |
| *A63B 23/16* | (2006.01) |

(Continued)

(52) U.S. Cl.

CPC ..... *A63B 21/0455* (2013.01); *A63B 21/0004* (2013.01); *A63B 21/026* (2013.01); *A63B 23/12* (2013.01); *A63B 23/14* (2013.01); *A63B 21/00061* (2013.01); *A63B 21/0555* (2013.01); *A63B 23/1209* (2013.01); *A63B 23/16* (2013.01); *A63B 2023/003* (2013.01)

(58) Field of Classification Search

CPC . A63B 21/026; A63B 21/045; A63B 21/0455; A63B 21/072–21/075; A63B 2023/003; A63B 21/000065; A63B 21/00185; A63B 21/4035; A63B 21/0004; A63B 21/05; A63B 21/055; A63B 21/0555; A63B 21/028; A63B 21/00061; A63B 23/1209; A63B 23/14; A63B 23/16

See application file for complete search history.

(56) References Cited

U.S. PATENT DOCUMENTS 3,510,130 A * 5/1970 Ferdinand ..... A63B 21/00043 482/127

6,059,700 A * 5/2000 Ellenburg ..... A63B 21/0728 482/107

(Continued)

*Primary Examiner* — Loan H Thanh

*Assistant Examiner* — Gregory Winter

(74) *Attorney, Agent, or Firm* — Garcia-Zamor IP Law; Ruy M. Garcia-Zamor

(57) ABSTRACT

A torsion bar includes a housing and at least one inner core. The housing has a receiving space, two opposite fixing grooves defined in a sidewall of the housing and communicating with the receiving space, and a plurality of stripes positioned at an outer surface thereof. The inner core is received in the receiving space, and includes two opposite fixing elements corresponding to the fixing grooves. Each of the fixing elements includes a plurality of first protruding portions located at a side end thereof to facilitate a user to disengage from the housing, and a plurality of second protruding portions located at a surface thereof adjacent to the side end to prevent the inner core from disengaging accidently from the housing. A cross-section of the receiving space is similar to a cross-section of the inner core.

6 Claims, 1 Drawing Sheet

(51) Int. Cl.
*A63B 23/00* (2006.01)
*A63B 21/055* (2006.01)

(56) References Cited

U.S. PATENT DOCUMENTS 6,106,438 A * 8/2000 Dean ..... A63B 21/0455
127/45
6,196,953 B1 * 3/2001 Buchanan ..... A63B 21/072
482/114
6,402,668 B1 * 6/2002 Harker ..... A63B 21/0004
482/121
7,182,716 B1 * 2/2007 Dawson ..... A63B 21/0728
482/104
7,951,051 B1 * 5/2011 Brown ..... A63B 21/0004
482/111
8,074,971 B2 * 12/2011 Yatagai ..... B01D 46/0093
261/106
2004/0082449 A1 * 4/2004 Brown, Jr. ..... A63B 21/026
482/140
2006/0276309 A1 * 12/2006 Ko ..... A63B 21/0552
482/91
2007/0049135 A1 * 3/2007 Allen ..... A63B 21/06
439/894
2009/0111662 A1 * 4/2009 Wagner ..... A63B 21/00065
482/45
2012/0040810 A1 * 2/2012 Astilla ..... A63B 21/00047
482/131
2015/0102028 A1 * 4/2015 Carrasca ..... A63B 6/00
220/23.83
2015/0190672 A1 * 7/2015 Rost ..... A63B 23/0355
482/93

* cited by examiner

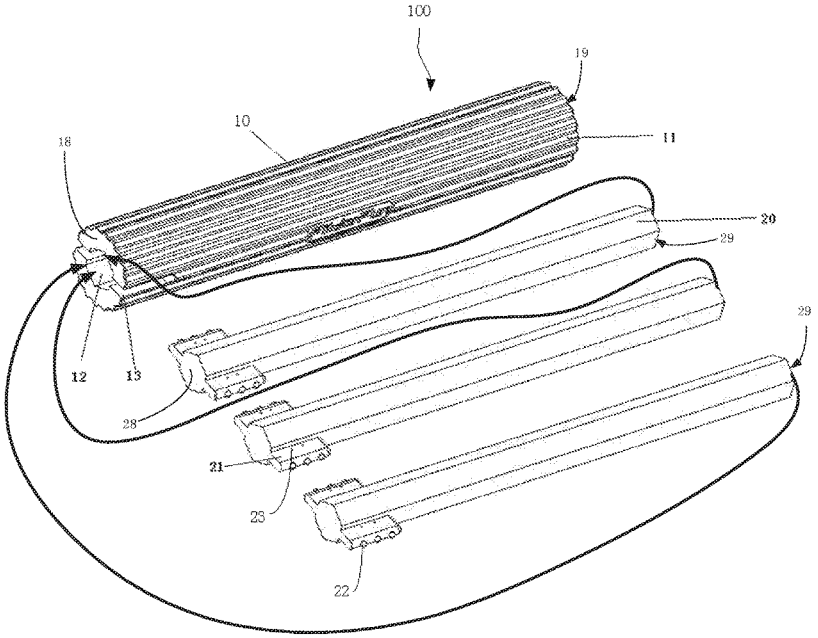
100
19
10
11
18
20
29
29
12
13
28
21
23
22

TORSION BAR

CROSS REFERENCE TO RELATED APPLICATIONS

This application claims priority to the following patent properties: Chinese Patent Application CN 201420464999.0, filed on Aug. 18, 2014, the above application is hereby incorporated by reference herein as if set forth in its entirety.

BACKGROUND

1. Technical Field

The present disclosure generally relates to a torsion bar, and especially to an adjustable torsion bar.

2. Description of Related Art

Torsion bars are popular equipment. However, the maximum torque of the traditional torsion bar is fixed. That is, one traditional torsion bar only has one fixed maximum torque, so user need to buy another torsion bars when needed.

Therefore, a need exists in the industry to overcome the described problems.

SUMMARY

The disclosure is to offer a torsion bar, especially to an adjustable torsion bar.

A torsion bar includes a housing having a receiving space, and at least one inner core received in the receiving space. Two opposite fixing grooves define a sidewall of the housing and communicate with the receiving space, and a plurality of stripes is position at outer surface thereof. The inner core comprises two opposite fixing elements corresponding to the fixing grooves, each of the fixing elements includes a plurality of first protruding portions located at a side end thereof to facilitate a user to disengage the inner core from the housing, and a plurality of second protruding portions are located at a surface thereof adjacent to the side end to prevent the inner core from disengaging accidently from the housing. A cross-section of the receiving space is similar to a cross-section of the inner core.

Preferably, the receiving space cuts through the housing.

Preferably, the fixing grooves extend from an end of the housing to the sidewall along an axis of the receiving space.

Preferably, the torsion bar includes a plurality of inner cores, and the inner cores have different hardness, maximum torques and colors.

Preferably, a length of the inner core is about 31 cm or similar to a length of the housing.

Preferably, the housing and the inner core are made of elastic material.

Preferably, the elastic material is natural rubber.

Preferably, an outer surface of the housing has a plurality of stripes.

It follows that, the torsion bar is made of natural rubber, such that user would not be allergic to synthetic rubber materials.

Furthermore, the torsion bar includes a plurality of inner cores, and the inner cores have different maximum torques and colors. User could choose from one of the inner cores and set it in the housing as needed, such that the specific forces or resistances could satisfy different practicing strength levels and ability of the users.

Furthermore, the stripes formed on the housing could improve the friction between user's hands and the housing and provide a good gripping on the torsion bar during exercises.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

FIG. 1 is an isometric view of a torsion bar according to an exemplary embodiment.

DETAILED DESCRIPTION

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

With reference to FIG. 1, the torsion bar 100 includes a housing 10 and at least one inner core 20.

The housing 10 can be made of elastic material, such as natural rubber. The outer surface of the housing 10 has a plurality of stripes 11. The stripes 11 can improve the friction between user hands and the housing 10.

The housing 10 further has a receiving space 12 extending from a first end 18 of the housing to a second end 19 of the housing 10 along an axial direction and two opposite fixing grooves 13. The housing 10 can have a hollow cylindrical structure. The fixing grooves 13 are defined in a sidewall of the housing 10 and extend from at the first end 18 of the housing 10 to the sidewall along an axis of the receiving space 12, and communicate with the receiving space 12, resulting in facilitating that the inner core 20 is inserted into the receiving space 12. In other embodiment, the housing 10 may be a hollow polygon structure, for example, a hollow hexagonal structure, a hollow square structure, a hollow triangle structure and so on. That is to say, a cross-section of the receiving space 12 is a cylindrical shape or a polygonal shape.

The inner core 20 can be made of elastic material, such as natural rubber. The inner core 20 has two opposite fixing elements 21 corresponding to the fixing grooves 13, and a length of the fixing groove 13 is general equal to a length of the fixing elements 21. A total length of the inner core 20 can be about 31cm or about a length of the housing. A cross-section of the inner core 20 is cylindrical shape or a polygonal shape similar to the cross-section of the receiving space 12. The inner core 20 and the fixing elements 21 are integral. The inner core 20 includes a first end 28 adjacent to the fixing elements 21, and a second end 29 apart from the fixing elements 21. In assembly, the inner core 20 is inserted into the receiving space 12, via the second end 29 of the inner core 20 extending from the first end 18 of the housing 10 to the second end 19 of the housing 10 until each of the fixing elements 21 of the inner core 20 is inserted into a corresponding fixing groove 13 and the first end 28 of the inner core 20 is in line with the first end 18 of the housing 10.

The two opposite fixing elements 21 can be formed on one end of the inner core 20, and the fixing elements 21 can have a shape corresponding to the fixing grooves 13. The inner core 20 can be received in the receiving space 12, and the two opposite fixing elements 21 can be respectively positioned in the fixing grooves 13, such that the inner core 20 can be easily locked in position with the housing 10. In addition, each of the fixing elements 21 includes a plurality of first protruding portions 22 located at a side end thereof to facilitate a user to disengage the inner core 20 from the housing 10, and a plurality of second protruding portions 23 located at a surface thereof adjacent to the side end to prevent the inner core 20 from disengaging accidently from the housing 10.

In at least on exemplary embodiment, the torsion bar 100 includes a plurality of inner cores 20, and the inner cores 20 can have different hardness, maximum torques and colors. Preferably, the torsion bar 100 has three inner cores 20, the maximum torque of the three inner cores 20 can be respectively about 2.27 kg (5 pound), 4.5 Kg (10 pound), 6.8 Kg (15 pound), and the three inner cores 20 can be yellow, green and blue respectively. User could put the inner core 20 into the housing 10, such that the torsion bar 100 can have different bending strengths and twisting strengths.

User can twist the torsion bar 100 towards clockwise and counterclockwise at the same time, or user can also bend the torsion bar 100, such that arms, hands, fingers, wrists of user can be trained or exercised.

When mounting the torsion bar 100, the inner core 20 can be received in the receiving space 12 of the housing 10, and the opposite fixing elements 21 can be engaged in the fixing grooves 13, such that the inner core 20 can be received in the housing 10, and the second protruding portions 23 on the fixing elements 21 can retain the core 20 in the fixing grooves 13 and receiving space 12.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A torsion bar comprising, a housing having a receiving space extending from a first end of the housing to a second end of the housing along an axial direction, two opposite fixing grooves defined in a sidewall of the first end of the housing and communicating with the receiving space, and a plurality of stripes positioned on an outer surface thereof; and an inner core received in the receiving space, the inner core comprising two opposite fixing elements corresponding to the fixing grooves, a first end of the inner core is adjacent to the fixing elements, and a second end of the inner core is apart from the fixing elements along the axial direction, each of the fixing elements including a plurality of first protruding portions located at a side end thereof to facilitate a user to disengage the inner core from the housing, and a plurality of second protruding portions located at a surface thereof adjacent to the side end to prevent the inner core from disengaging accidently from the housing, wherein the inner core and the fixing elements are integral;

wherein a cross-section of the receiving space is similar to a cross-section of the inner core;

wherein the inner core is inserted into the receiving space via the second end of the inner core and extended from the first end of the housing to the second end of the housing until each of the fixing elements is inserted into a corresponding fixing groove and the first end of the inner core is in line with the first end of the housing.

2. The torsion bar of claim 1, wherein the fixing grooves extend from the first end of the housing to the sidewall along an axis of the receiving space.

3. The torsion bar of claim 1, wherein the torsion bar includes a plurality of the inner cores, and the inner cores have different hardness, maximum torques and colors, and wherein the plurality of inner cores are interchangeably received in the receiving space.

4. The torsion bar of claim 3, wherein a length of each of the plurality of inner cores is about 31 cm or similar to a length of the housing.

5. The torsion bar of claim 1, wherein the housing and the inner core are made of elastic material.

6. The torsion bar of claim 5, wherein the elastic material is natural rubber.

* * * * *